US009101516B2

(12) United States Patent
Roussy et al.

(10) Patent No.: US 9,101,516 B2
(45) Date of Patent: Aug. 11, 2015

(54) STEERABLE ULTRA-LOW PATIENT BED

(71) Applicant: Stryker Corporation, Kalamazoo, MI (US)

(72) Inventors: Donald Roussy, London (CA); Richard Brian Roussy, London (CA); George Roussy, London (CA)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 13/769,547

(22) Filed: Feb. 18, 2013

(65) Prior Publication Data

US 2013/0180051 A1 Jul. 18, 2013

Related U.S. Application Data

(66) Continuation of application No. 10/548,410, filed as application No. PCT/CA2004/000356 on Mar. 10, 2004, now Pat. No. 8,381,330, Substitute for application No. 60/477,329, filed on Jun. 11, 2003.

(60) Provisional application No. 60/453,210, filed on Mar. 11, 2003.

(51) Int. Cl.
*A61G 7/012* (2006.01)
*A61G 1/017* (2006.01)
(Continued)

(52) U.S. Cl.
CPC ..... *A61G 7/012* (2013.01); *A61G 1/017* (2013.01); *A61G 1/0237* (2013.01); *A61G 1/0243* (2013.01); *A61G 2007/0528* (2013.01)

(58) Field of Classification Search
CPC ..... A61G 1/013; A61G 1/02; A61G 1/0212; A61G 1/0237; A61G 1/0243; A61G 7/008; A61G 7/012; A61G 13/04; A61G 13/06
USPC ..... 5/11, 600, 611, 620, 86.1, 625–627; 16/35 R; 188/1.12; 296/20
See application file for complete search history.

(56) References Cited

U.S. PATENT DOCUMENTS 3,305,876 A 2/1967 Hutt
4,097,939 A 7/1978 Peck et al.
(Continued)

FOREIGN PATENT DOCUMENTS

EP 0558108 A2 1/1993
GB 1440329 A 6/1976
(Continued)

*Primary Examiner* — Nicholas Polito
(74) *Attorney, Agent, or Firm* — Warner Norcross & Judd LLP

(57) ABSTRACT

A steerable ultra-low patient bed incorporates means for maintaining verticality of the caster stem at all height positions of the bed, and means for selectively locking the caster assemblies of the bed in a desired locking position. The means for selectively locking the caster assemblies may be actuated from either end of the bed using a central actuation mechanism. The bed preferably has legs that are pivotally and translatably attached at their upper end to the bed frame, and caster support members that are longitudinally aligned with the bed pivotally attached to the lower end of each leg. Each caster support member has a single caster assembly attached thereto. The means for maintaining verticality of the caster stem incorporates a constraint means that urges the caster support member in a direction of rotation opposite that of the leg during adjustment of the height of the bed.

49 Claims, 12 Drawing Sheets

(51) Int. Cl.
*A61G 1/02* (2006.01)
*A61G 7/05* (2006.01)

(56) References Cited

U.S. PATENT DOCUMENTS

| | | | | |
|---|---|---|---|---|
| 4,131,485 | A | 12/1978 | Meinel et al. | |
| 4,175,783 | A | 11/1979 | Pioth | |
| 4,309,791 | A | 1/1982 | Aulik | |
| 4,313,024 | A | 1/1982 | Home | |
| 4,345,344 | A | 8/1982 | Gadoury et al. | |
| 4,432,353 | A | 2/1984 | Vrzalik | |
| 4,685,160 | A | 8/1987 | Rizzardo | |
| 4,998,320 | A * | 3/1991 | Lange | 16/35 R |
| 5,022,105 | A | 6/1991 | Catoe | |
| 5,118,361 | A | 6/1992 | Fraas et al. | |
| 5,148,562 | A | 9/1992 | Borders et al. | |
| 5,317,769 | A | 6/1994 | Weismiller et al. | |
| 5,418,987 | A | 5/1995 | Yoshino | |
| 5,432,966 | A | 7/1995 | Berta et al. | |
| 5,594,961 | A | 1/1997 | Yokoi et al. | |
| 5,613,255 | A | 3/1997 | Bish et al. | |
| 5,669,090 | A * | 9/1997 | Basgall | 5/620 |
| 5,713,091 | A | 2/1998 | Houchin | |
| 6,161,236 | A | 12/2000 | Carroll | |
| 6,230,344 | B1 * | 5/2001 | Thompson et al. | 5/611 |
| 6,264,006 | B1 | 7/2001 | Hanson et al. | |
| 6,351,861 | B1 | 3/2002 | Shows et al. | |
| 6,405,393 | B2 | 6/2002 | Megown | |
| 6,473,922 | B1 | 11/2002 | Sommerfeld et al. | |
| 6,516,479 | B1 * | 2/2003 | Barbour | 5/618 |
| 6,578,216 | B1 | 6/2003 | Aarestad | |
| 6,601,251 | B2 | 8/2003 | Paul | |
| 6,868,567 | B2 | 3/2005 | Edgerton | |
| D505,365 | S | 5/2005 | Thompson et al. | |
| 6,920,656 | B2 * | 7/2005 | Roussy | 5/611 |
| 6,941,600 | B2 | 9/2005 | Freeborn et al. | |
| 7,003,828 | B2 | 2/2006 | Roussy | |
| 7,013,510 | B1 | 3/2006 | Johnson | |
| 7,134,155 | B2 | 11/2006 | Freeborn et al. | |
| 7,150,056 | B2 | 12/2006 | Lemire | |
| 7,185,377 | B2 | 3/2007 | Roussy | |
| 7,296,312 | B2 | 11/2007 | Menkedick et al. | |
| 7,334,277 | B2 | 2/2008 | Johnson | |
| 7,386,900 | B2 | 6/2008 | Lemire | |
| 7,406,731 | B2 | 8/2008 | Menkedick et al. | |
| 7,421,748 | B1 | 9/2008 | Edgerton | |
| 7,435,898 | B2 | 10/2008 | Shifman | |
| 7,454,805 | B2 | 11/2008 | Osborne et al. | |
| 7,509,697 | B2 | 3/2009 | Dorenbeck | |
| 7,533,429 | B2 | 5/2009 | Menkedick et al. | |
| 7,610,637 | B2 | 11/2009 | Menkedick et al. | |
| 7,631,379 | B2 | 12/2009 | Lindner | |
| 7,637,550 | B2 | 12/2009 | Menna | |
| 7,653,954 | B2 | 2/2010 | Hornbach et al. | |
| 7,703,157 | B2 | 4/2010 | Dorenbeck | |
| 7,810,188 | B2 | 10/2010 | Barthelt | |
| 7,849,538 | B1 | 12/2010 | Edgerton | |
| 7,913,335 | B2 | 3/2011 | Carr | |
| 7,941,881 | B2 | 5/2011 | Hayes et al. | |
| 8,065,764 | B2 | 11/2011 | Kramer | |
| 8,074,309 | B2 | 12/2011 | Hutchison et al. | |
| 8,104,120 | B2 | 1/2012 | Hornbach et al. | |
| 8,117,696 | B2 | 2/2012 | Wernqvist et al. | |
| 8,151,387 | B2 | 4/2012 | Osborne et al. | |
| 8,176,584 | B2 | 5/2012 | Hornbach et al. | |
| 8,234,729 | B2 | 8/2012 | Yvernault et al. | |
| 8,256,048 | B2 | 9/2012 | Bly et al. | |
| 8,291,532 | B2 | 10/2012 | Hornbach et al. | |
| 8,321,976 | B1 | 12/2012 | Edgerton | |
| 8,381,330 | B2 * | 2/2013 | Roussy et al. | 5/86.1 |
| 8,516,634 | B2 | 8/2013 | Turner et al. | |
| 8,607,384 | B2 | 12/2013 | Hornbach | |
| 8,621,690 | B2 | 1/2014 | Hornbach et al. | |
| 2002/0148044 | A1 | 10/2002 | Hayes et al. | |
| 2003/0037814 | A1 | 2/2003 | Cohen et al. | |
| 2003/0093862 | A1 | 5/2003 | Hanson et al. | |
| 2005/0125899 | A1 | 6/2005 | Hanson et al. | |
| 2006/0225203 | A1 | 10/2006 | Hosoya et al. | |
| 2006/0254762 | A1 | 11/2006 | Tao et al. | |
| 2007/0083992 | A1 | 4/2007 | Lindner et al. | |
| 2007/0256724 | A1 | 11/2007 | Fork et al. | |
| 2009/0211636 | A1 | 8/2009 | Lin | |
| 2010/0064441 | A1 | 3/2010 | Barthelt | |
| 2010/0325797 | A1 | 12/2010 | Horne | |
| 2012/0060291 | A1 | 3/2012 | Gamman et al. | |
| 2013/0036550 | A1 | 2/2013 | Bly et al. | |
| 2013/0174341 | A1 | 7/2013 | Shang | |
| 2013/0180051 | A1 | 7/2013 | Roussy et al. | |
| 2013/0219382 | A1 | 8/2013 | Parsons et al. | |
| 2013/0227787 | A1 | 9/2013 | Herbst et al. | |
| 2013/0318720 | A1 | 12/2013 | Connell et al. | |

FOREIGN PATENT DOCUMENTS

| | | | |
|---|---|---|---|
| GB | 2068301 | A | 8/1981 |
| JP | 06-342922 | A | 12/1994 |
| JP | 2005-076967 | A | 3/2005 |
| WO | 0226187 | A1 | 4/2002 |
| WO | 0234191 | A1 | 5/2002 |

* cited by examiner

STEERABLE ULTRA-LOW PATIENT BED

This application is a continuation of U.S. application Ser. No. 10/548,410, filed Sep. 8, 2005, now U.S. Pat. No. 8,381,330, issued Feb. 26, 2013, which is a §371 of PCT/CA2004/000356, filed Mar. 10, 2004, which claims priority to U.S. application No. 60/477,329, filed Jun. 11, 2003, and No. 60/453,210, filed Mar. 11, 2003, all of which are incorporated herein by reference.

FIELD OF THE INVENTION

The invention relates to beds for patients, such as patients in hospitals or long-term care facilities. More particularly, the invention relates to an adjustable height patient bed having an ultra-low lowermost height position, due primarily to the absence of a lower secondary frame, having caster wheels and having means that permit the bed to be easily steered by an attendant.

BACKGROUND OF THE INVENTION

Patient beds are used anywhere medical care is provided to patients, for example in hospitals and in long-term care facilities, such as palliative care facilities and nursing homes. Patients sometimes fall from their beds, often resulting in injury to the patient. One way of minimizing the likelihood of injury is to reduce the distance between the patient and the floor by providing a height adjustable bed capable of achieving an ultra-low lowermost height position, for example, on the order of 12 to 14 inches between the top of the mattress and the floor. These types of beds will be referred to herein as ultra-low beds. Ultra-low beds typically achieve this ultra-low lowermost position by eliminating the lower secondary frame connecting the legs of the bed that is common in many height adjustable patient beds, especially those used in hospitals. The legs of the bed are instead pivotally attached to the frame of the bed, allowing the legs to collapse beneath the bed when the bed is lowered and permitting the bed to attain the ultra-low lowermost position. An example of such a bed is provided in co-pending commonly held patent application WO 02/26187, filed on Sep. 28, 2001 by the inventor of the present invention, which is hereby incorporated by reference.

Ultra-low beds are typically equipped with caster assemblies at the lower end of each leg to permit the bed to be mobile. The caster assemblies each have a stem for attaching the caster assembly to the bed leg that is offset from the center of the caster wheel. The caster wheel swivels about the stem when the bed is propelled along the floor so that the caster wheel tracks the direction of movement of the bed. This allows the bed to be propelled in any desired direction. In order for the wheel to swivel about the stem, the stem must remain substantially vertical; a non-vertical stem does not allow the caster wheel to track the movement of the bed, thereby restricting the bed to movement only in a single straight line direction. Ultra-low beds are typically mobile only in selected height positions of the bed; for example, the bed disclosed in WO 02/26187, supra, is mobile only in the uppermost height position of the bed and at all other height positions a foot engages the floor to prevent mobility of the bed. However, in some circumstances it is desirable for the bed to be mobile in all height positions, especially when the bed is used in hospitals. Since the legs are pivotally attached to the frame, adjusting the height of the bed causes the lower end of the legs to angularly move with respect to the floor when the height is adjusted. This causes the caster stem to adopt a non-vertical orientation at all but one height position of the bed, preventing the caster wheels from swiveling in order to track the direction of movement of the bed.

The need for maintaining verticality of the caster stem as the height of the bed is adjusted has been identified and dealt with in the prior art. U.S. Pat. No. 6,405,393, filed Dec. 19, 2000 by Megown and issued Jun. 18, 2002 (Megown) discloses a caster support assembly wherein two caster assemblies are provided, one on either side of the pivotal attachment of the leg to the caster support assembly. This causes the caster support assembly to remain in position as the leg angularly moves when the height of the bed is adjusted, thereby maintaining verticality of the caster stem. However, this bed requires two caster assemblies to be attached to the caster support member, which increases the cost of the bed and makes the bed more difficult to maneuver when propelled by an attendant. Also, one of the caster assemblies remains underneath the frame when the bed is lowered to the lowermost position, increasing the minimum distance between the top of the mattress and the floor, which negates some of the advantage of an ultra-low bed in preventing patient injury. European Patent EP 0 558 108, filed Feb. 1, 1993 by applicant Schell Industries BV and granted Sep. 29, 1996 (Schell) discloses a bed with a caster support that is transversely aligned with the frame and attached to a transverse axle that pivots as the height of the bed is adjusted. The caster stem is located on the centerline of the transverse axle so that the caster stem remains vertical as the axle is pivoted. The transverse caster support member offsets the caster assemblies along the width of the bed so that they do not interfere with the frame when the bed is lowered to the lowermost position. This undesirably increases the width of the bed, which can cause problems when negotiating openings such as doorways, etc. with the bed.

The bed disclosed in WO 02/26187, supra, has caster support members which are pivotally attached to the lower end of each leg and longitudinally aligned with the bed frame. The caster assemblies are outward of the frame along the length of the bed, permitting the bed to be lowered to an ultra-low lowermost position without interference between the caster assemblies and the frame and without increasing the overall width of the bed. However, this type of bed suffers from the problem of non-verticality of the caster stem as the height of the bed is adjusted, preventing swiveling of the casters and movement of the bed in any desired direction.

The need therefore exists for an improved ultra-low bed that is steerable in all height positions of the bed.

To further enhance steering of the bed, it is desirable to selectively lock one or more of the caster assemblies at one end of the bed so that the caster assembly or assemblies are prevented from swiveling. The end of the bed with the locked caster assembly or assemblies will then follow the change in direction imparted to the unlocked caster assemblies, allowing the bed to be more easily maneuvered by a single attendant around obstacles and corners. When the bed is pushed by an attendant from one end, it is further desirable for the locked caster assembly to be located at the opposite end of the bed; this allows the bed to be pushed without the opposite end changing direction uncontrollably. Selectively lockable caster assemblies may prevent swiveling of the caster assembly, prevent rotation of the caster wheel, or prevent both swiveling and rotation. Lockable caster assemblies are known in the prior art; see, for example, U.S. Pat. No. 4,998,320, filed Nov. 1, 1989 by Lange and issued Mar. 12, 1991.

Since the caster assembly to be locked is typically located at the end of the bed opposite the attendant, it is desirable for the bed to be equipped with a central actuation mechanism that permits the caster assemblies to be selectively locked from only one end of the bed. Central actuation mechanisms are known on beds having a secondary frame; see, for example, U.S. Pat. No. 6,321,878 filed Mar. 5, 1999 by Mobley, et al. and issued Nov. 27, 2001. However, these types of central actuation mechanisms cannot be readily adapted to ultra-low beds since no secondary frame structure is available for mounting the mechanism and for connecting the front and rear legs. Schell, supra, discloses a central actuation mechanism for preventing rotation of the caster wheels that is electrically powered. In this mechanism, each caster assembly must be electrically actuated, increasing the cost of the bed. Also, the bed requires a source of electrical power to selectively lock the caster assemblies, which may not be available when the bed is being moved.

The need therefore exists for an improved central actuation mechanism for selectively locking one or more caster assemblies on an ultra-low bed.

SUMMARY OF THE INVENTION

According to an aspect of the invention, there is provided an ultra-low patient bed having a frame with front and rear legs, each leg having an upper end pivotally attached to the frame and a lower end, pivoting of the legs permitting the frame to be raised and lowered between a lowermost and uppermost position, the bed comprising: a caster support member pivotally attached to the lower end of each leg, the caster support member longitudinally aligned with the frame, the leg pivoting about the caster support member in a first direction when the frame is lowered; a single caster assembly attached to each caster support member, the caster assembly comprising a caster stem and at least one caster wheel, the caster stem having a vertical orientation; and, a constraint means attached to the caster support member, the constraint means urging the caster support member to pivot in a second direction opposite the first direction when the frame is lowered to thereby maintain the vertical orientation of the caster stem.

According to another aspect of the invention, there is provided an ultra-low patient bed having a frame with front and rear legs, each leg having an upper end pivotally attached to the frame and a lower end, pivoting of the legs permitting the frame to be raised and lowered between a lowermost and an uppermost position, the bed comprising: a caster support member pivotally attached to the lower end of each leg, the caster support member longitudinally aligned with the frame and pivotable in response to raising and lowering of the frame; a single caster assembly attached to each caster support member, the caster assembly comprising a caster stem having a vertical orientation and at least one caster wheel, the caster wheel rotatable when the bed is moved and able to swivel about the caster stem to permit steering movement of the bed; a means for maintaining the vertical orientation of the caster stem as the bed is raised and lowered; a means for selectively locking one or more of the caster assemblies; and, a central actuation mechanism for actuating the means for selectively locking.

In the present invention, a means for maintaining verticality of the caster stem at all height positions of the bed is provided. As used herein, "vertical" means an upright orientation that allows the caster to swivel about the stem in response to directional changes of the bed and includes orientations other than orthogonal with respect to a floor surface. Similarly, maintaining verticality also includes slight changes in upright orientation. The means for maintaining verticality may comprise a constraint means attached to the caster support member. The constraint means urges the caster support member to rotate in a second direction opposite to a first direction, the first direction being the direction of angular movement of the leg member when the height of the bed is adjusted. The first direction lies in a vertical plane parallel with the length of the bed. The net result of this movement is that the caster support member and the attached caster stem maintain their orientation with respect to the floor when the leg moves in the first direction.

The front legs may comprise a pair of front legs attached to one another at the upper end thereof. The front legs may thereby form a U-shaped leg member pivotally and translatably attached at the upper end to the bed frame. The same arrangement may be used for the rear legs. The caster support member is longitudinally aligned with the frame and may be pivotally attached at one end to the lower end of the leg. The other end of each caster support member may be oriented outwardly towards the nearest end of the frame; this is referred to herein as the outward end of the caster support member. The caster assembly may be attached to the caster support member at the outward end thereof, with the caster stem having a vertical orientation. Attaching the caster assembly at the outward end of the caster support member allows the caster assembly to be outward of the frame along the length of the bed when the bed is lowered to the lowermost position, which may permit the bed to be lowered closer to the floor than would otherwise be permitted if the caster were beneath the frame of the bed. The caster assembly may comprise one or more caster wheels having a common axis of rotation through the center of the wheels. The caster stem is preferably offset from the center of the wheels to allow the caster to swivel about the stem in response to changes in the direction of movement of the bed.

The caster support member may be cantilevered with respect to the leg. The constraint means allows the caster support member to maintain this cantilevered position at all times, even during adjustment of the height of the bed. The point of pivotal attachment of the caster support member to the leg is separated a distance from the floor and this distance remains constant during adjustment of the height of the bed due to the action of the constraint means. The geometry of the legs is such that the caster assembly preferably does not translate along the floor during adjustment of the height of the bed. This allows the bed to be positioned adjacent a wall without interference with the wall when the height is adjusted. Alternatively, the geometry of the legs may be such that the caster translates along the floor in certain applications. The constraint means may be attached to the caster support member between the caster assembly and the pivotal attachment of the caster support member to the leg.

In one embodiment, the constraint means may comprise a control arm pivotally attached at one end to the caster support member between the caster assembly and the leg. A leg brace may be pivotally attached to both the leg and the frame and may extend from the leg towards the nearest end of the bed. An isosceles triangle may be formed between the points of pivotal attachment of the leg brace to the frame, the leg to the frame, and the leg brace to the leg. An apex of the isosceles triangle is located at the point of attachment of the leg brace to the leg; an equal distance is thereby provided between the apex and the two points of pivotal attachment to the frame. The isosceles triangle is preserved during adjustment of the height of the bed. The other end of the control arm may be pivotally attached to the leg brace proximal the point of attachment of the leg brace to the leg. The control arm, the leg brace, the leg, and the caster support member may therefore be connected at four points that define a quadrilateral. During adjustment of the height of the bed, the upper part of the leg translates along the length of the frame as the leg pivots. In order to preserve the isosceles triangle, the leg brace moves in the opposite direction relative to the leg as the apex of the triangle moves towards the frame. The movement of the leg brace causes the attached control arm to urge the caster support member to rotate in the second direction, opposite the first direction of rotation by the leg.

In the above embodiment, the control arm has a fixed length. Alternatively, the control arm may be attached to any other suitable member, such as a fixed member of the frame, and the control arm may be variable in length in response to adjusting the height of the bed. The variation of length may be accomplished by any suitable means, for example a telescoping member and/or a resiliently damped member, such as a spring, that is adjusted to maintain the caster support member in its preferred orientation with respect to the floor.

In another embodiment, the constraint means may comprise a planetary gear arrangement. Angular movement of the leg in a first direction causes the planetary gear arrangement to urge the caster support member in a second direction opposite the first direction. This maintains the vertical orientation of the caster stem with respect to the floor and also preserves the distance between the floor and the point of pivotal attachment of the caster support member to the leg. The planetary gear arrangement may comprise, for example: a leg gear fixedly attached to the leg concentric with the pivotal attachment of the leg to the caster support member; a support gear rotatably attached to the caster support member by means of a gear shaft extending therefrom, the support gear engaged with the leg gear; and, a ring gear fixedly attached to the caster support member concentric with the pivotal attachment of the leg to the caster support member, the ring gear engaged with the support gear. Upon angular movement of the leg, the leg gear turns with the leg relative to the caster support member. This causes the support gear to turn about the gear shaft in the opposite direction to the leg gear. This in turn causes the ring gear to turn in the same direction as the support gear, causing the caster support member to pivot about the pivotal attachment of the leg to the caster support member. The end result is that, upon angular movement of the leg, the caster support member pivots in the opposite direction. The gear ratios may be selected so that the caster stem retains its vertical orientation throughout the pivoting movement of the leg. The caster support member may remain cantilevered at all height positions of the bed. The leg gear, the support gear and the ring gear may be co-planar. Since the leg moves angular through a limited range, the support gear need not necessarily be completely round but could instead be a pie-shaped section of a round gear corresponding to the range of movement of the leg.

In yet another embodiment, the planetary gear arrangement may comprise the leg gear and the caster support gear only, with the caster support gear powered by a motor means and operable to rotate. This allows the caster support member to adopt any desired orientation relative to the leg. The caster support member may comprise a foot on an opposite end of the caster support member from the caster assembly with the point of pivotal attachment of the leg to the caster support member between the foot and the caster assembly. The bed may rest on the foot and the motor may be selectively operated to rotate the caster support gear, raising the foot from the floor and forcing the caster stem to adopt a vertical orientation to render the bed mobile at any height position.

To further improve steering of the bed, one or more caster assemblies may be selectively lockable by a central actuation mechanism. The central actuation mechanism may be actuated from one end or both ends of the bed. The central actuation mechanism may be foot operated, for example by a foot pedal that may be rotated in a clockwise or counter-clockwise direction, or operated by any other suitable means, such as an electronic control system.

Each caster assembly has a means for selectively locking the caster assembly. The means for selectively locking may be within the caster assembly. The means for selectively locking has a neutral position wherein the caster assembly swivels freely about the caster stem and wherein the caster wheel freely rotates. The means for selectively locking also may have a plurality of locking positions. For example, in a first locking position, swiveling of the caster assembly about the caster stem is prevented. In a second locking position, rotation of the caster wheel about its axis of rotation is prevented. In a third locking position, both swiveling of the caster assembly about the caster stem and rotation of the caster wheel about its axis of rotation are prevented. Additional locking positions may also be provided.

The locking position of one or more caster assemblies may be different from the locking position of the remaining caster assemblies. For example, the caster assemblies attached to the rear or foot of the bed may be selectively locked in a first locking position that prevents swiveling, whereas the caster assemblies at the front or head of the bed may lack that locking position and therefore remain in the neutral position. This allows the rear of the bed to be steered in response to changes in direction imparted by an attendant at the front of the bed. By having different available locking positions at the front and rear of the bed, a central actuation mechanism may be employed that is attached to each caster assembly and acts on each caster assembly in the same way, but still produces different locking effects at the front and rear of the bed.

To achieve steering of a desired end of the bed, only a single caster assembly at that end needs to be locked in a first locking position that prevents swiveling. However, it is preferable for two caster assemblies to be provided with a first locking position at the same end of the bed so that the ability to steer the bed is retained over uneven floor conditions, such as at the entrance to an elevator or ramp, when contact of one of the locked caster assemblies with the floor surface may be interrupted.

The central actuation mechanism may comprise a front foot pedal and a rear foot pedal, each foot pedal operable to rotate in a clockwise or counter-clockwise direction. The central actuation mechanism may further comprise a front foot pedal shaft and a rear foot pedal shaft, each foot pedal shaft longitudinally aligned with the bed and attached to its respective foot pedal, each foot pedal shaft operable to rotate in a clockwise or counter-clockwise direction in response to rotation of the foot pedal in a clockwise or counter-clockwise direction. A front caster assembly shaft may be attached to the caster assemblies of the front legs and a rear caster assembly shaft may be attached to the caster assemblies of the rear legs, each caster assembly shaft transversely aligned with the bed and operable to rotate in a clockwise or counter-clockwise direction to selectively lock the caster assemblies in a desired locking position. A front shaft linkage and a rear shaft linkage may be provided that each operably interconnect their respective foot pedal shaft and caster assembly shaft. Each shaft linkage is operable to cause rotation of one interconnected shaft in response to rotation of the other interconnected shaft. The net result is that by rotating the foot pedal in a clockwise or counter clockwise direction, the interconnected shafts also rotate and the locking position of the caster assemblies at the front and rear of the bed is changed.

The central actuation mechanism includes a means for transmitting a change in locking position of the caster assemblies at one end of the bed to the caster assemblies at the other end of the bed. The means may be activated by the foot pedal and attached to either the shaft linkage or the caster assembly shaft at each end of the bed. It is desirable that very little of the energy input into the central actuation mechanism is lost in the transmittal of the change in locking position from one end of the bed to the other. The means for transmitting desirably transmits directly and simultaneously the change in locking position from one end of the bed to the other.

In one embodiment, the means for transmitting a change in locking position comprises a front hydraulic cylinder and a rear hydraulic cylinder, each hydraulic cylinder operably interconnected by hydraulic fluid conduits to transmit a change in locking position of the caster assemblies of the front or rear legs simultaneously to the caster assemblies of the opposite legs by means of hydraulic fluid displacement. The cylinders may be attached to the shaft linkage that operably interconnects the caster assembly shaft and the foot pedal shaft and activated by the foot pedal. The cylinder at the end of the bed with the foot pedal being actuated acts to transfer a volume of hydraulic fluid to the hydraulic cylinder at the opposite end of the bed. The volume of the cylinders is matched so that the volume of fluid transferred causes the cylinder at the opposite end of the bed to act directly and simultaneously on its respective shaft linkage. This produces a rotation of the caster assembly shaft and a change in locking position accompanied by a rotation of the foot pedal at the opposite end of the bed. In this embodiment, the cylinders are double acting so that fluid is displaced from the cylinders regardless of the direction of rotation of the foot pedal. In another embodiment, a pair of single acting cylinders may be provided at each end of the bed in place of the double acting cylinder. In yet another embodiment, the matched cylinders may be replaced or augmented by a hydraulic pump for transferring hydraulic fluid to the cylinders and activated in response to a change in locking position of the caster assemblies.

In another embodiment, the means for transmitting a change in locking position may comprise a pair of cables. Each cable may be connected at one end to the front caster assembly shaft and at the other end to the rear caster assembly shaft by means of a dog extending in a radial direction outwardly from the shaft. Each dog may be angularly spaced apart and oriented so that tension applied to one or the other cable causes rotation of the caster assembly shaft in a clockwise or counter-clockwise direction, respectively. In this arrangement, rotation of either the front or rear caster assembly shaft in either direction applies a tension to one of the cables, thereby causing rotation of the opposite caster assembly shaft in the same direction and a corresponding change in locking position of the opposite caster assemblies.

In yet another embodiment, the means for transmitting a change in locking position may comprise a mechanical linkage longitudinally aligned with the bed and operably interconnecting the front and rear foot pedal shafts. The front and rear foot pedal shafts may lie in a first horizontal plane and the mechanical linkage may lie in a second horizontal plane elevated from the first horizontal plane when the bed is in a raised position. This allows the mechanical linkage to connect the front and rear foot pedal shafts without reducing the minimum height between the bed legs, which is desirable especially in hospital beds to allow insertion of equipment between the legs that spans the width of the bed, such as tray tables and patient lifts. The mechanical linkage may be connected to the front and rear foot pedal shaft by means of universal joints to permit the linkage to function as the legs are pivoted. The mechanical linkage may also telescope in response to pivoting of the front and rear legs. Rotation of the front or rear foot pedal shaft causes rotation of the mechanical linkage and a corresponding rotation of the opposite foot pedal shaft, thereby effecting a change in locking position of the opposite caster assemblies through the interconnection of the shafts by the shaft linkage.

BRIEF DESCRIPTION OF THE DRAWINGS

Having regard to the foregoing, preferred embodiments of the invention will now be described with reference to the accompanying figures, in which.

DETAILED DESCRIPTION OF THE EMBODIMENTS

Figure 1:
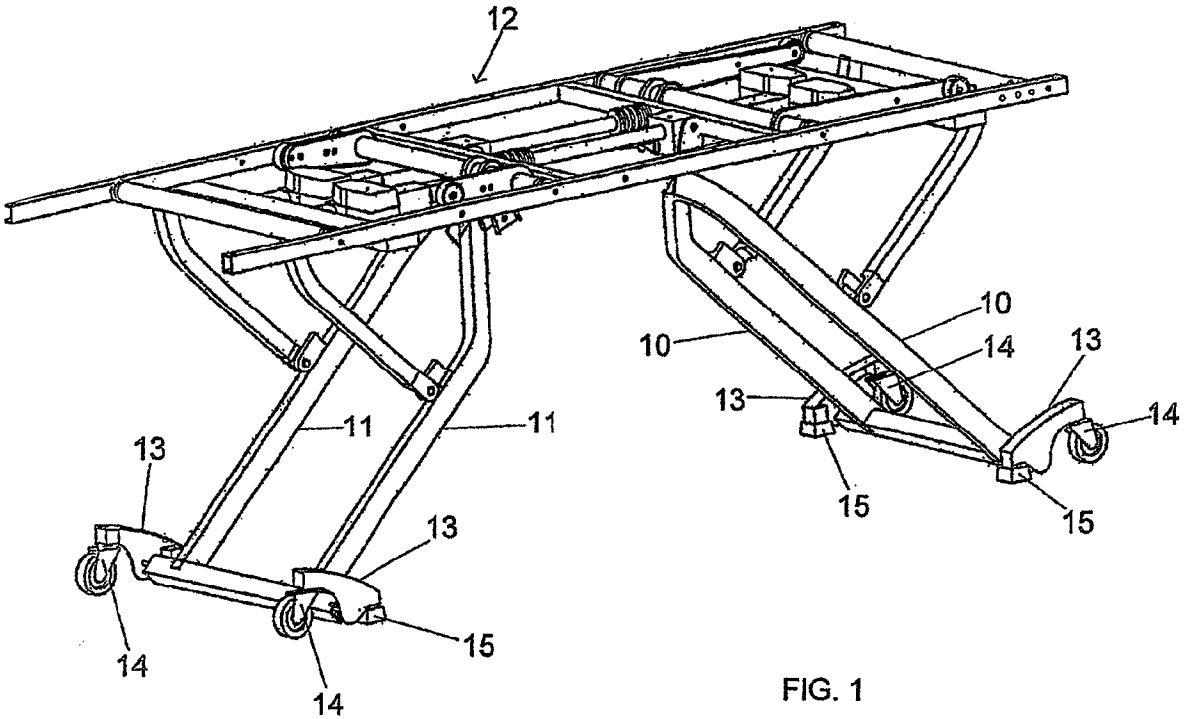
FIG. 1 PRIOR ART
FIG. 1 shows a perspective view of a prior art ultra-low bed.
Figure 2:
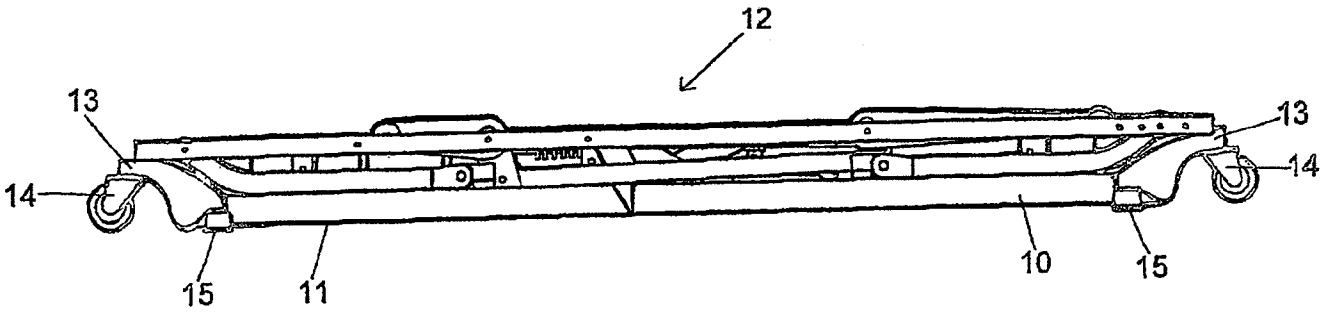
FIG. 2 PRIOR ART
FIG. 2 shows a side view of a prior art ultra-low bed in the ultra-low lowermost position.

Referring to FIGS. 1 and 2, a prior art ultra-low bed is shown. Ultra low beds have a pair of front legs 10 and a pair of rear legs 11 attached to a frame 12. In the bed shown, each of the front legs 10 and the rear legs 11 is attached to one another at an upper end thereof and the upper end is pivotally and translatably attached to the frame 12. The front legs 10 and rear legs 11 form a generally U-shaped member. To adjust the height of the bed, the legs translate along the frame. Of note is the absence of a lower frame connecting the legs of the bed. This permits the bed to attain the ultra-low height position shown in FIG. 2. Caster support members 13 are attached to the lower end of each leg. Each caster support member 13 has a caster assembly 14 and a foot 15. As can be seen in FIG. 2, the prior art bed rests on the foot 15 when the bed is in the lowered position, rendering the bed immobile. Only at the uppermost height position of the bed does the foot 15 disengage from the floor, rendering the bed mobile on the caster assembly 14.

Figure 3:
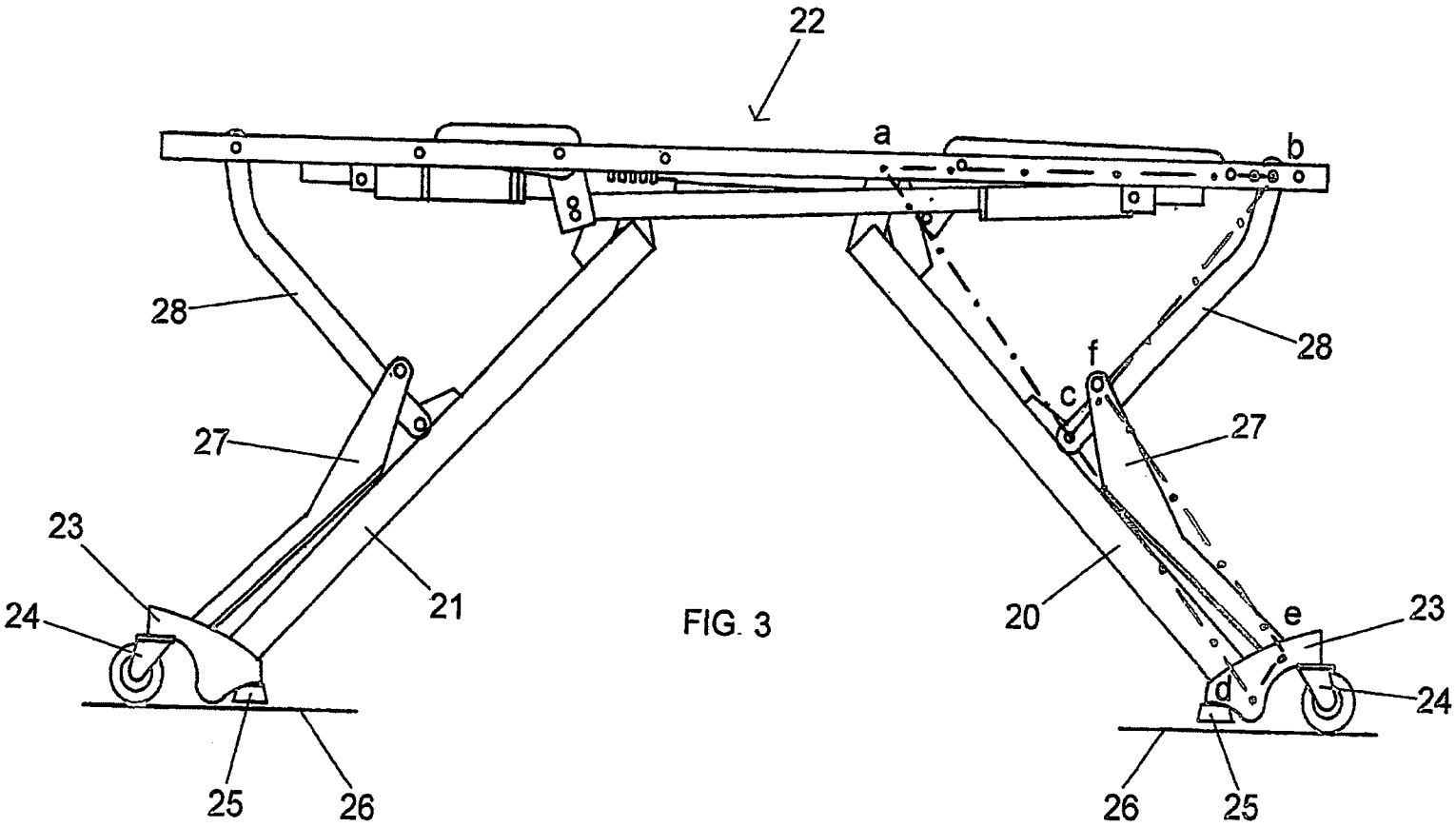
FIG. 3 shows a side view of an embodiment of a constraint means according to the present invention.

Referring to FIG. 3, an embodiment of a bed according to the present invention has a pair of front legs 20 and a pair of rear legs 21 attached to a frame 22. Each of the front legs 20 and rear legs 21 is attached to one another at an upper end thereof and the upper end is pivotally and translatably attached to the frame 22. To adjust the height of the bed, the legs translate along the frame. Caster support members 23 are attached to the lower end of each leg. Each caster support member 23 has a caster assembly 24 and a foot 25. The foot 25 need not necessarily be present in this embodiment, but may be present in any of the embodiments. The foot 25 is separated a distance from the floor surface 26 and remains separated from the floor surface at all height positions of the bed. A constraint means is provided for each caster support member 23, in this embodiment a control arm 27, to maintain the separation of the foot 25 from the floor surface 26. Each control arm 27 is pivotally attached at one end to the caster support member 23 between the caster assembly 24 and the point of pivotal attachment of the legs 21, 22 to their respective caster support members 23. The other end of each control arm 27 is pivotally attached to a leg brace 28.

Referring to the front legs 20, each leg brace 28 is pivotally attached to one of the front legs 20 at a point indicated schematically as c and extends towards the nearest end of the bed, in this case the front of the bed. Each leg brace 28 is pivotally attached to the frame 22 at a point indicated schematically as b. Each of the front legs 20 is pivotally and translatably attached to the frame 22 at a point indicated schematically as a. An isosceles triangle is formed between the points a-b-c, with an apex at point c. Both the legs 20 and the leg braces 28 are fixed length members; accordingly, the distances between points a-c and points b-c remain constant. An isosceles triangle is thereby preserved during height adjustment of the bed. As point a translates along the frame, the distance between points a-b changes and the apex of the triangle at point c moves relative to the frame 22. For example, as the bed is lowered, point a translates towards the rear of the bed and point c moves toward the frame 22, reducing the height of the isosceles triangle.

Each of the front legs 20 is pivotally attached to a caster support member 23 at a point indicated schematically as d. Each control arm 27 is pivotally attached at one end to a caster support member 23 at a point indicated schematically as e. The other end of each control arm 27 is pivotally attached to a leg brace 28 at a point indicated schematically as f. The points c-d-e-f generally form a quadrilateral. The distances between the points are fixed. As the height of the bed is adjusted, point f pivots about point c and point e tends to pivot about point d. For example, as the height of the bed is lowered, point f pivots in a clockwise direction about point c and point e tends to pivot in a clockwise direction about point d, urging the caster support member 23 to pivot in a second direction, clockwise, about point d. However, as point a translates toward the rear of the bed and the height of the bed is lowered, the front leg 20 pivots in a first direction, counter-clockwise, about point d. The caster support member 23 is constrained by the fixed length of the control arm 27 and the net result is that the distance between the foot 25 and the floor surface 26 is preserved as the leg pivots about point d. This maintains the vertical orientation of the caster assembly 24 with respect to the floor surface 26 as the height of the bed is adjusted.

Figure 4:
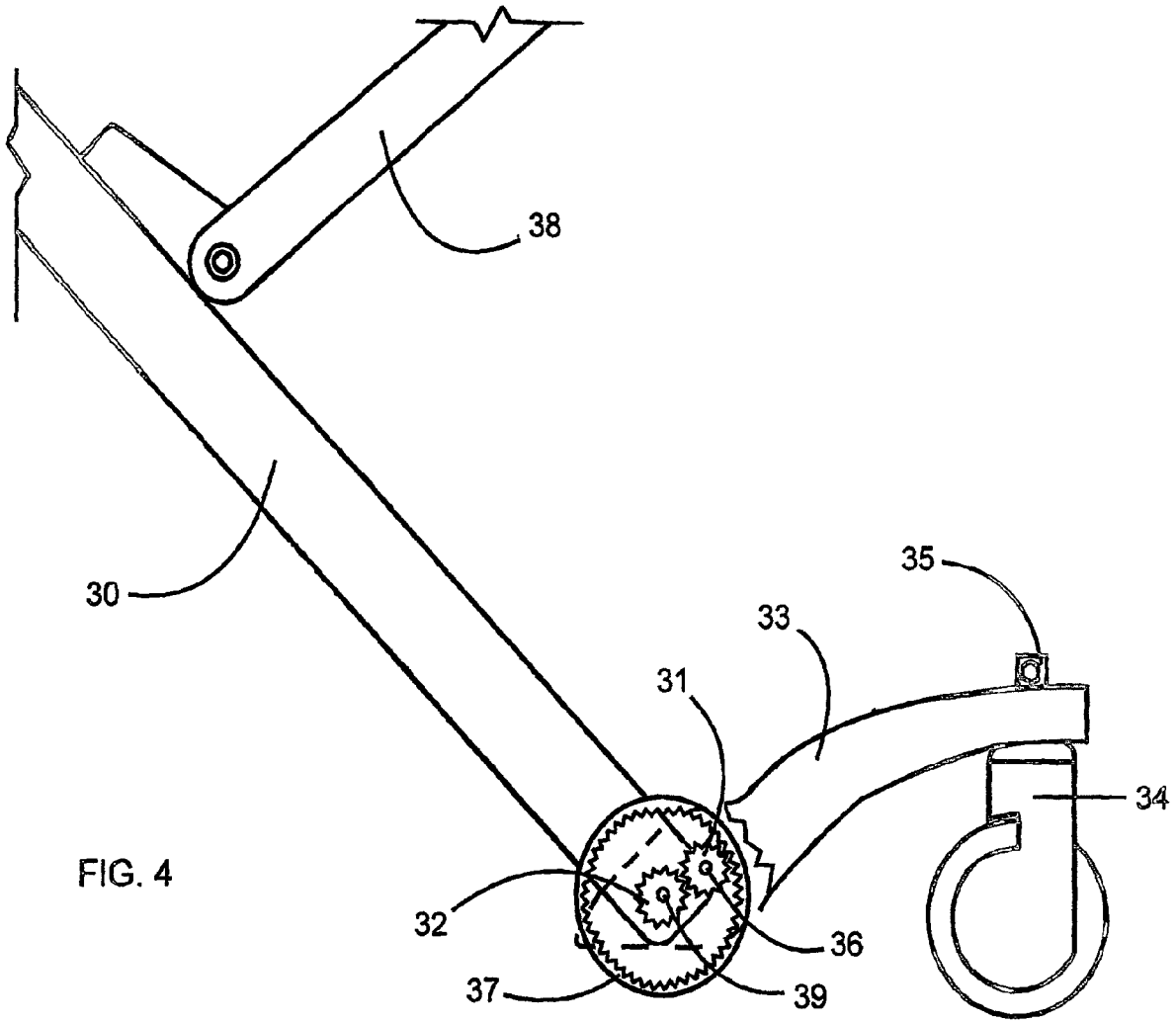
FIG. 4 shows a side view of another embodiment of a constraint means according to the present invention.

Referring to FIG. 4, an embodiment of a constraint means according to the present invention is shown comprising a planetary gear arrangement. The leg 30 and leg brace 38 are shown. A caster support member 33 is pivotally attached at one end to the leg 30 at a pivot point 39. The caster support member 33 is longitudinally aligned with the bed and oriented outwardly towards an end of the bed. A caster assembly 34 is attached to the outward end of the caster support member 33. The caster assembly has a caster stem 35 with a vertical orientation. A support gear 31 is rotationally attached to the caster support member 33 by means of a gear shaft 36. The support gear 31 is engaged with a leg gear 32 fixedly attached to the leg 30 concentric with the pivotal attachment of the leg 30 to the caster support member 33 at pivot point 39. A ring gear 37 is fixedly attached to the caster support member 33 concentric with the pivot point 39 and engaged with the support gear 31.

As the bed is lowered, the leg 30 tends to rotate in a first direction about the pivot point 39, counter-clockwise. The leg gear 32 is attached to the leg and also rotates in a counter-clockwise direction. This causes the engaged support gear 31 to rotate about the shaft 36 in a second direction, opposite the first direction, clockwise. The rotation of the support gear 31 causes the ring gear 37 to rotate in the second direction, clockwise, and urges the caster support member 33 to rotate in the same clockwise direction about the pivot point 39. The end result is that the vertical orientation of the caster stem 35 is maintained as the height of the bed is adjusted.

Figure 5:
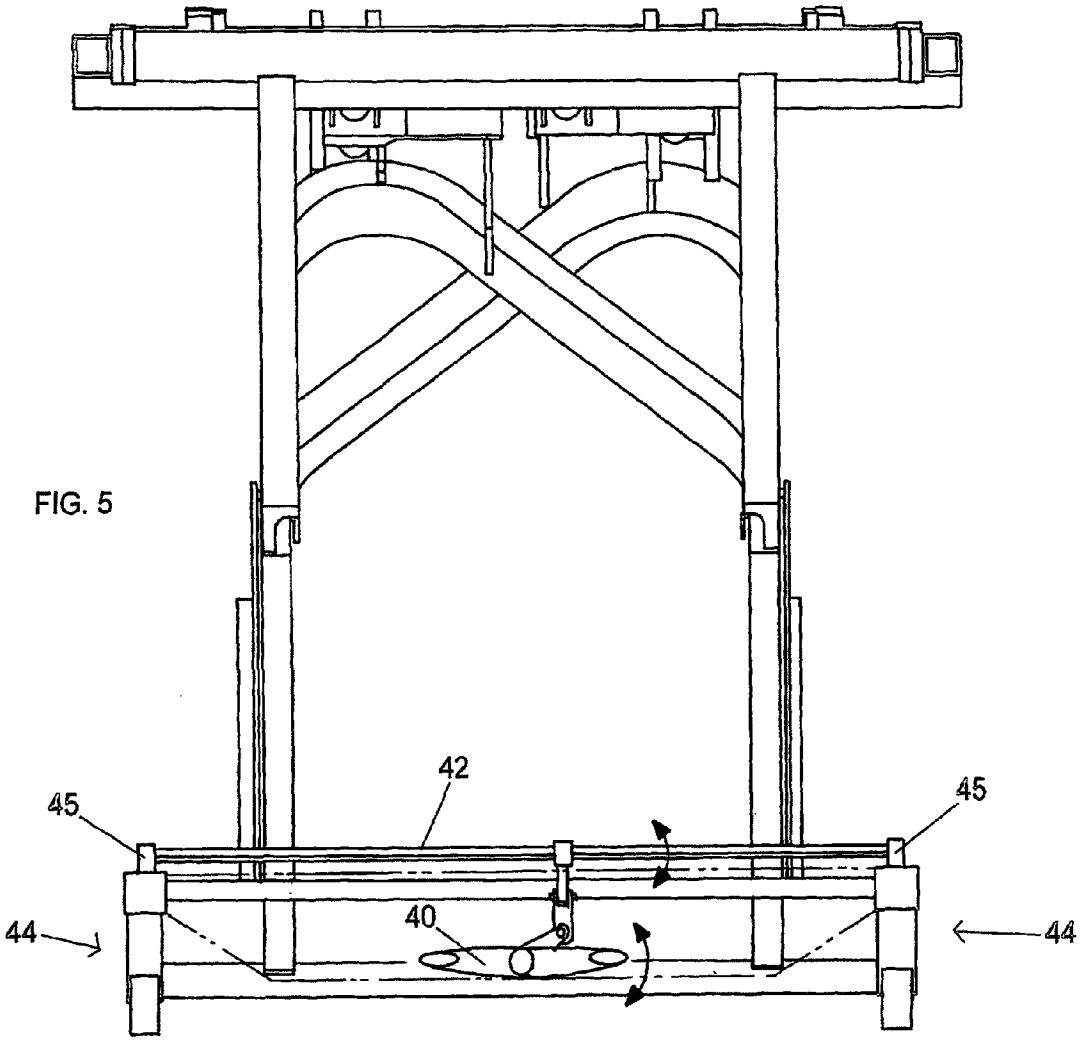
FIG. 5 shows an end view of an embodiment of a central actuation mechanism according to the present invention.

Referring to FIG. 5, a central actuation mechanism is shown. The central actuation mechanism is foot operated and comprises a foot pedal 40 that is rotatable in a clockwise or counter-clockwise direction. The foot pedal 40 is attached to a foot pedal shaft (not shown) that is longitudinally aligned with the bed and extends towards the opposite end of the bed. A caster assembly shaft 42 is transversely aligned with the bed and connected to the caster stem 45 of each caster assembly 44. The shaft has a hexagonal cross-section and is engaged within a complementary orifice through a portion of each caster stem 45. Rotation of the caster assembly shaft 42 causes each of the caster assemblies 44 to change locking position. For example, rotation of the caster assembly shaft 42 in a clockwise direction causes each caster assembly 44 to adopt a first locking position, whereas rotation of the caster assembly shaft 42 in a counter-clockwise direction causes each caster assembly 44 to adopt a second locking position.

The mechanism by which rotational movement of the foot pedal 40 is transferred to rotational movement of the caster assembly shaft 42 is common to all embodiments and can be explained with reference to FIG. 6. The foot pedal shaft 41, shown in phantom, is interconnected with the caster assembly shaft 42 by means of a shaft linkage. The shaft linkage comprises a caster assembly shaft dog 47, a foot pedal shaft dog 48, and a dog interlink 49. Each dog is perpendicular to its respective shaft so that rotation of the foot pedal 40 is transferred to rotation of the caster assembly shaft 42. For example, as the foot pedal 40 is rotated in a clockwise direction, the foot pedal shaft 41 rotates clockwise, causing the foot pedal shaft dog 48 to move arcuately upwardly, causing the dog interlink 49 to translate upwardly, causing the caster assembly shaft dog 47 to move arcuately upwardly, thereby rotating the caster assembly shaft 42 in a counter-clockwise direction as viewed from the left side of the bed. The rotation of the caster assembly shaft 42 causes a change in locking position of the caster assemblies 44.

Figure 6:
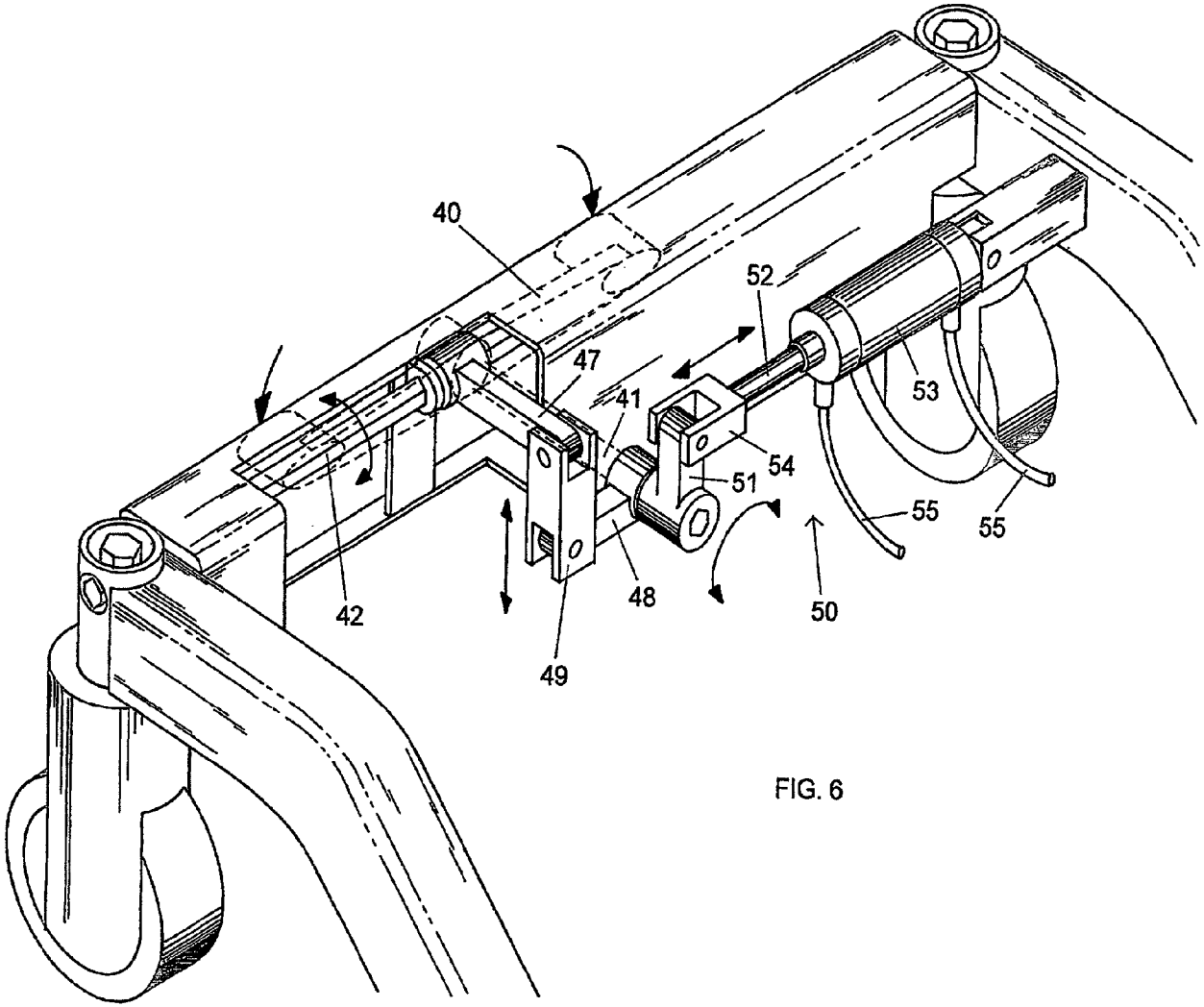
FIG. 6 shows a perspective view of an embodiment of central actuation mechanism according to the present invention that is fluid powered.
Figure 7:
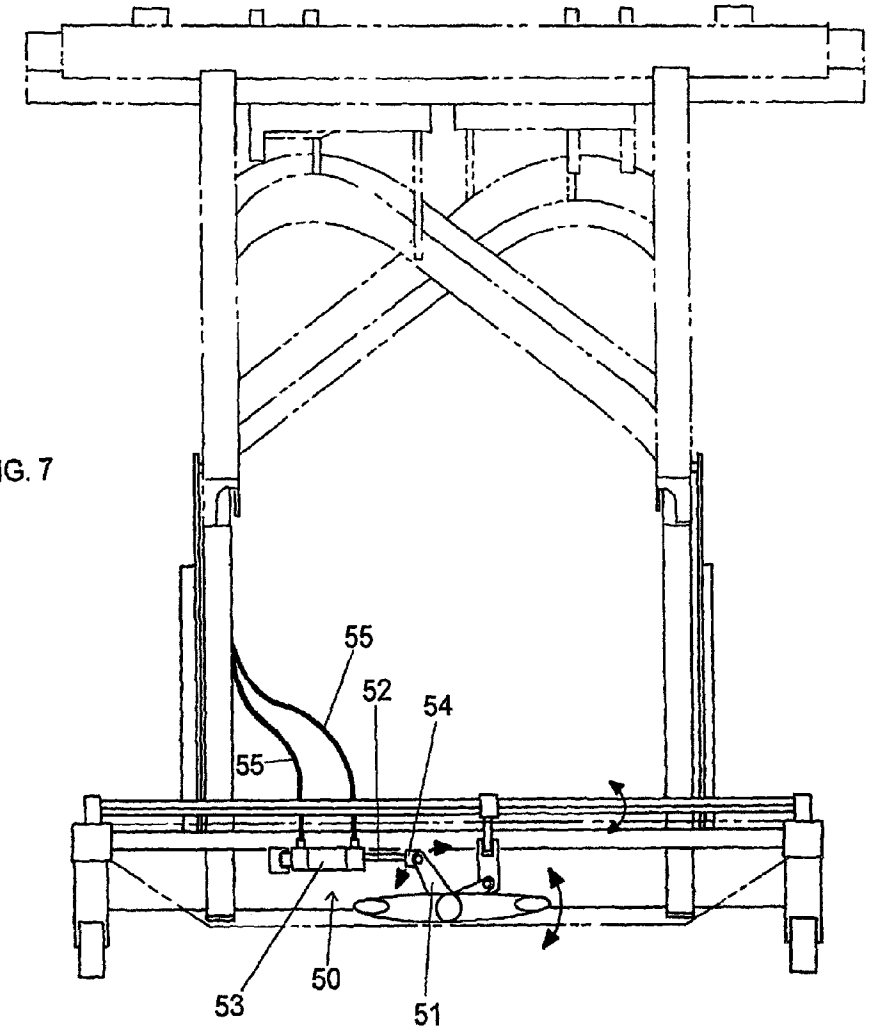
FIG. 7 shows an end view of the embodiment of shown in FIG. 6.
Figure 8:
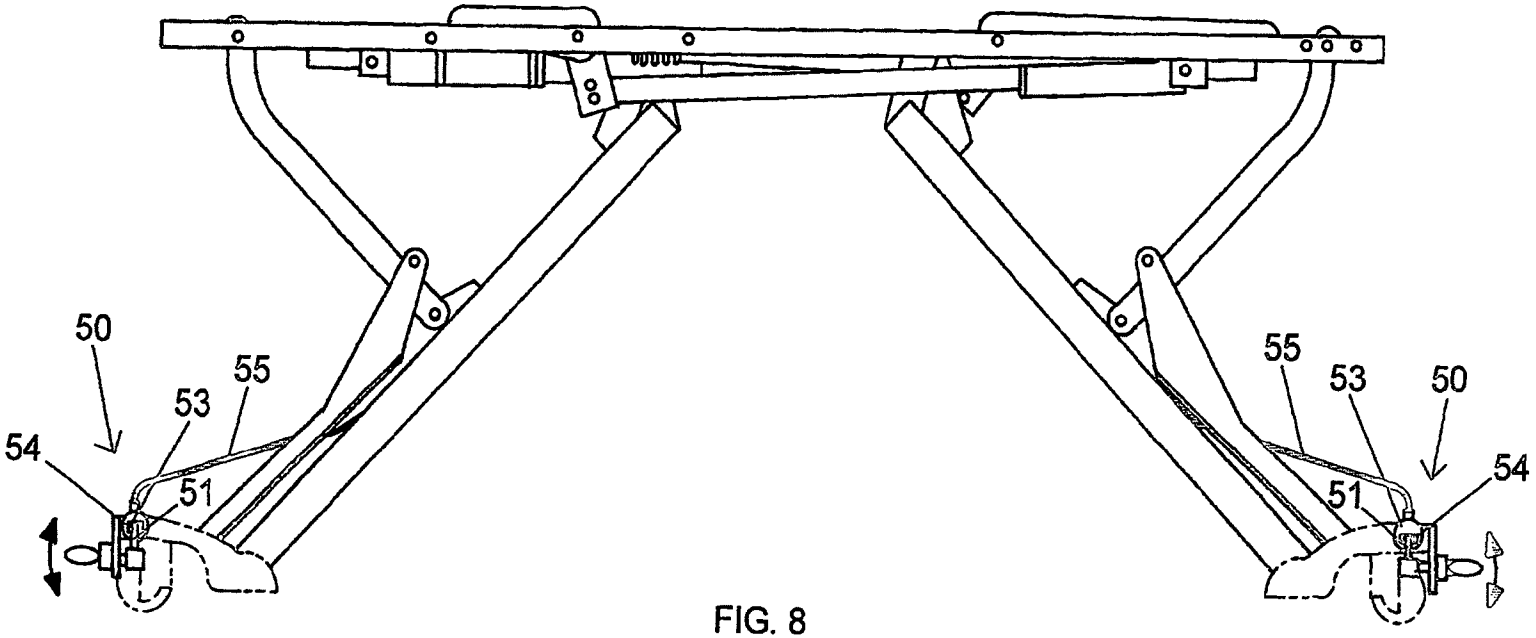
FIG. 8 shows a side view of the embodiment shown in FIG. 6.

Referring to FIGS. 6-8, a means for transmitting a change in locking position is shown that uses a hydraulic fluid system. The shaft linkage includes a cylinder dog 51 that is perpendicular to the foot pedal shaft 41 (not shown in FIGS. 7 and 8). A hydraulic cylinder 50 is provided with a cylinder rod 52 attached to a piston (not shown) that is translatable within the cylinder chamber 53. The cylinder rod 52 is pivotally attached to the cylinder dog 51 by means of a cylinder dog yoke 54. The cylinder chamber 53 has a pair of hydraulic fluid conduits 55 connected thereto, each conduit for receiving hydraulic fluid from one side of the piston as it translates within the cylinder chamber. When the foot pedal 40 is rotated, the foot pedal shaft 41 (not shown in FIGS. 7 and 8) and attached cylinder dog 51 also rotate. The cylinder dog 51 acts upon the cylinder dog yoke 54 to cause the piston to translate within the cylinder chamber 53, thereby displacing hydraulic fluid through one of the hydraulic fluid conduits 55. At the opposite end of the bed, the same hydraulic cylinder arrangement exists and the displaced fluid causes translational movement of the piston within the chamber, thereby causing a corresponding movement of the cylinder rod, shaft linkage, foot pedal, and caster assembly shaft. Actuation of a foot pedal at either end of the bed therefore produces a corresponding change in locking position at the opposite end of the bed.

The hydraulic fluid system in this embodiment forms a closed circuit. As the piston at the opposite end of the bed translates within the cylinder, hydraulic fluid is displaced through the other hydraulic fluid conduit 55 back to the cylinder at the end of the bed where the foot pedal is being actuated. This fluid fills the volume within the cylinder chamber 53 created during movement of the piston. The cylinder is double-acting and is therefore capable of displacing fluid in both directions of movement of the piston. The volume of the cylinders is matched so that displacement of a volume of hydraulic fluid due to translation of the cylinder rod 52 a certain distance produces the same distance of translation of the cylinder rod at the opposite end of the bed. Due to the restriction caused by passage of the hydraulic fluid through the hydraulic fluid conduits 55, a pressure difference exists within the chamber from one side of the piston to the other when the foot pedal is being actuated. The entire hydraulic fluid system is charged to a positive pressure to help reduce this effect and to prevent intrusion of air into the cylinder during operation. The presence of the cylinder rod on one side of the piston reduces the available piston area upon which hydraulic fluid can act. To prevent inadvertent movement of the piston due to the positive pressure, the hydraulic fluid on the rod side of the piston may be charged to a greater pressure than the fluid on the opposite side. The difference in charging pressure is selected so that the force applied to the piston on both sides is approximately equal. In another embodiment, a pair of single acting cylinders is provided at each end of the bed in place of a single double-acting cylinder. In yet another embodiment, the hydraulic fluid system incorporates a pump, valves, and/or a hydraulic fluid reservoir.

Figure 9:
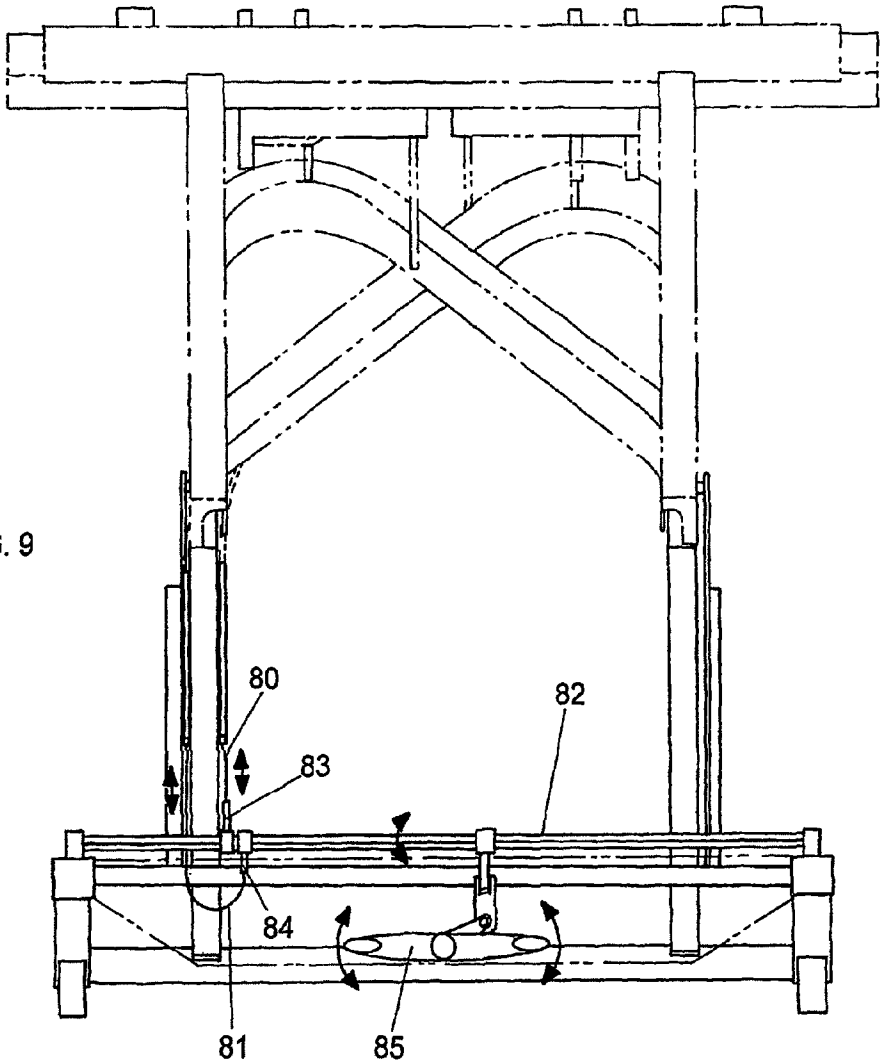
FIG. 9 shows an end view of another embodiment of a central actuation mechanism according to the present invention that employs cables.
Figure 10:
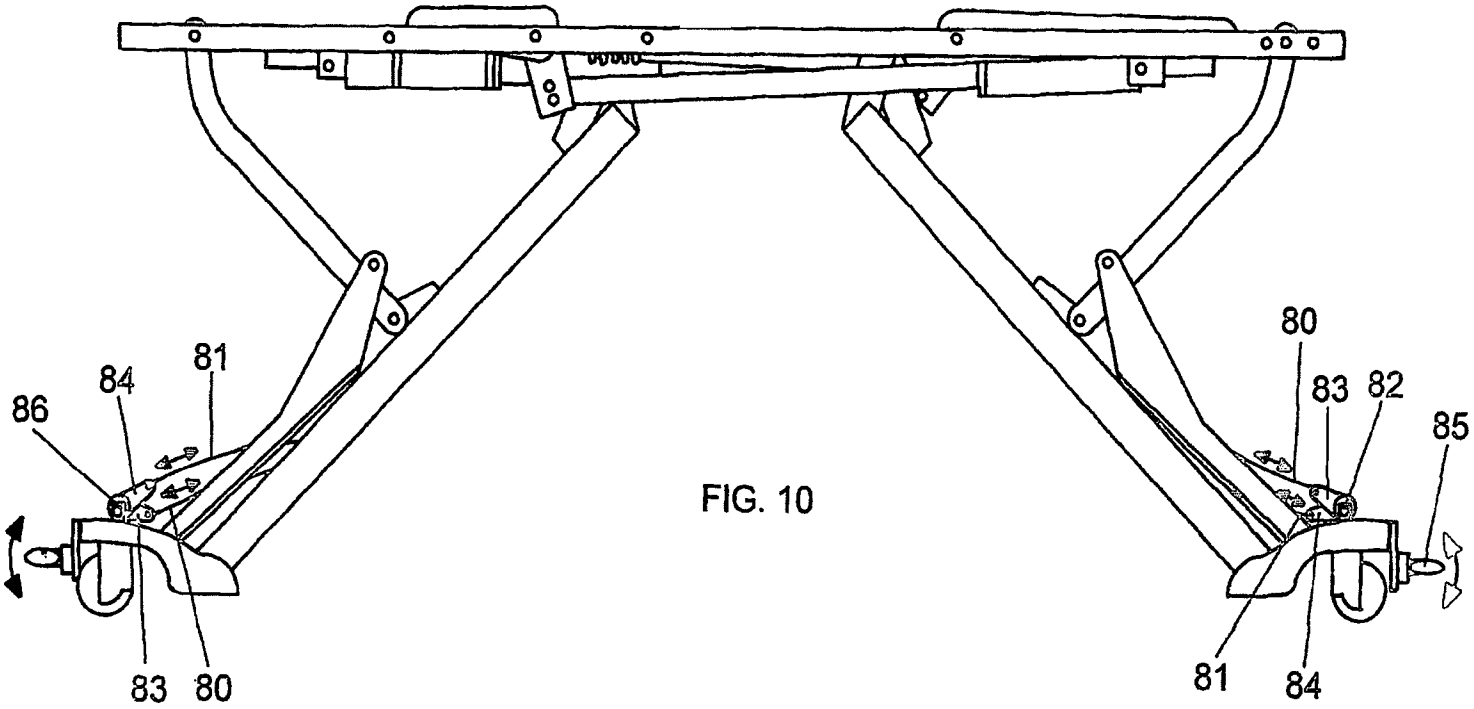
FIG. 10 shows a side view of the embodiment shown in FIG. 10.

Referring to FIGS. 9 and 10, another embodiment of a means for transmitting a change in locking position is shown. The means comprises a pair of cables 80, 81, each cable connected to the front caster assembly shaft 82 and rear caster assembly shaft 86 at both ends of the bed. The cables 80, 81 are connected by means of caster assembly shaft dogs 83, 84, respectively, to the caster assembly shafts 82, 86. The caster assembly shaft dogs 83, 84 extend radially outwardly from the caster assembly shafts 82, 86 and are angularly offset from one another. The direction of applied tension from the cables 80, 81 is such that a tension applied to one of the cables causes the shaft to rotate in one direction, and a tension applied to the other cable causes the shaft to rotate in the opposite direction. For example, rotation of the front foot pedal 85 in a counter-clockwise direction causes the front caster assembly shaft 82 to rotate in a clockwise direction as viewed from the left, causing caster assembly shaft dog 83 to move arcuately upwardly, causing a tension to be applied to cable 80. This in turn causes a counter-clockwise rotation, as viewed from the left, of the rear caster assembly shaft 86 at the opposite end of the bed and a corresponding change in locking position of the caster assemblies. Rotation of the front foot pedal 85 in the other direction would cause a tension to be applied in a similar manner to cable 81, producing a corresponding change in locking position at the opposite end of the bed.

Figure 11:
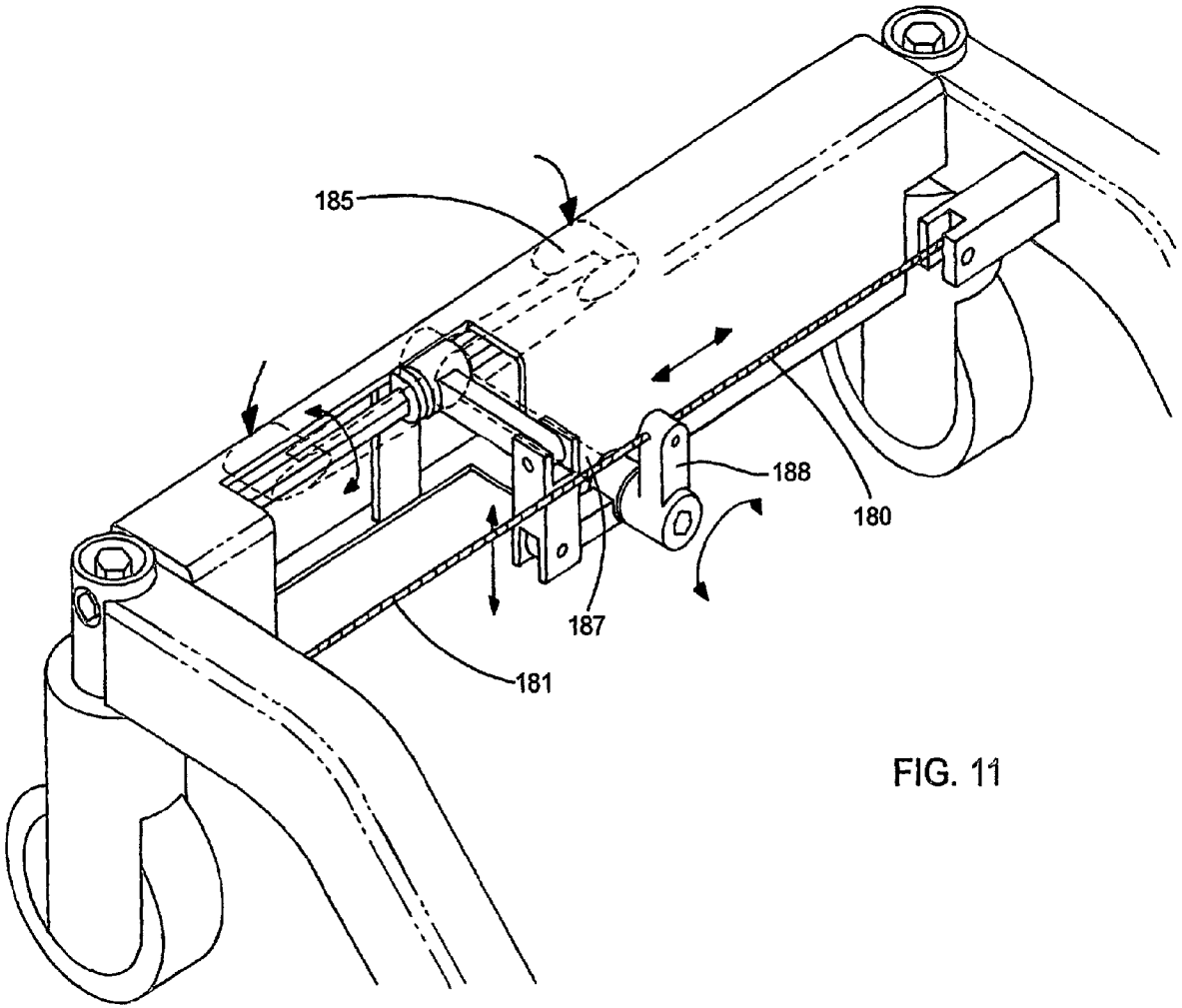
FIG. 11 shows a perspective view of yet another embodiment of a central actuation mechanism according to the present invention that employs cables; and, FIG. 12 shows a side view of yet another embodiment of a central actuation mechanism according to the present invention employing a mechanical linkage.

Referring to FIG. 11, another embodiment of a means for transmitting a change of locking position employing cables is shown. A foot pedal 185 is operatively connected to a foot pedal shaft 187. Attached to the foot pedal shaft 187 and extending radially therefrom is a cable dog 188. A pair of opposed cables, 180, 181 is provided, each cable connected on opposite sides of the cable dog 188. Operation of the foot pedal 185 causes rotation of the foot pedal shaft 187 in a clockwise or counter-clockwise direction and a corresponding arcuate movement of the cable dog 188, thereby applying a tension to cable 180 or 181, respectively. Each cable 180, 181 is connected at its opposite end to a similar structure, so that rotation of the foot pedal 185 at one end of the bed in one direction causes a complementary rotation of the foot pedal at the opposite end of the bed in the opposite direction and a corresponding change in locking position of the caster assemblies.

Figure 12:
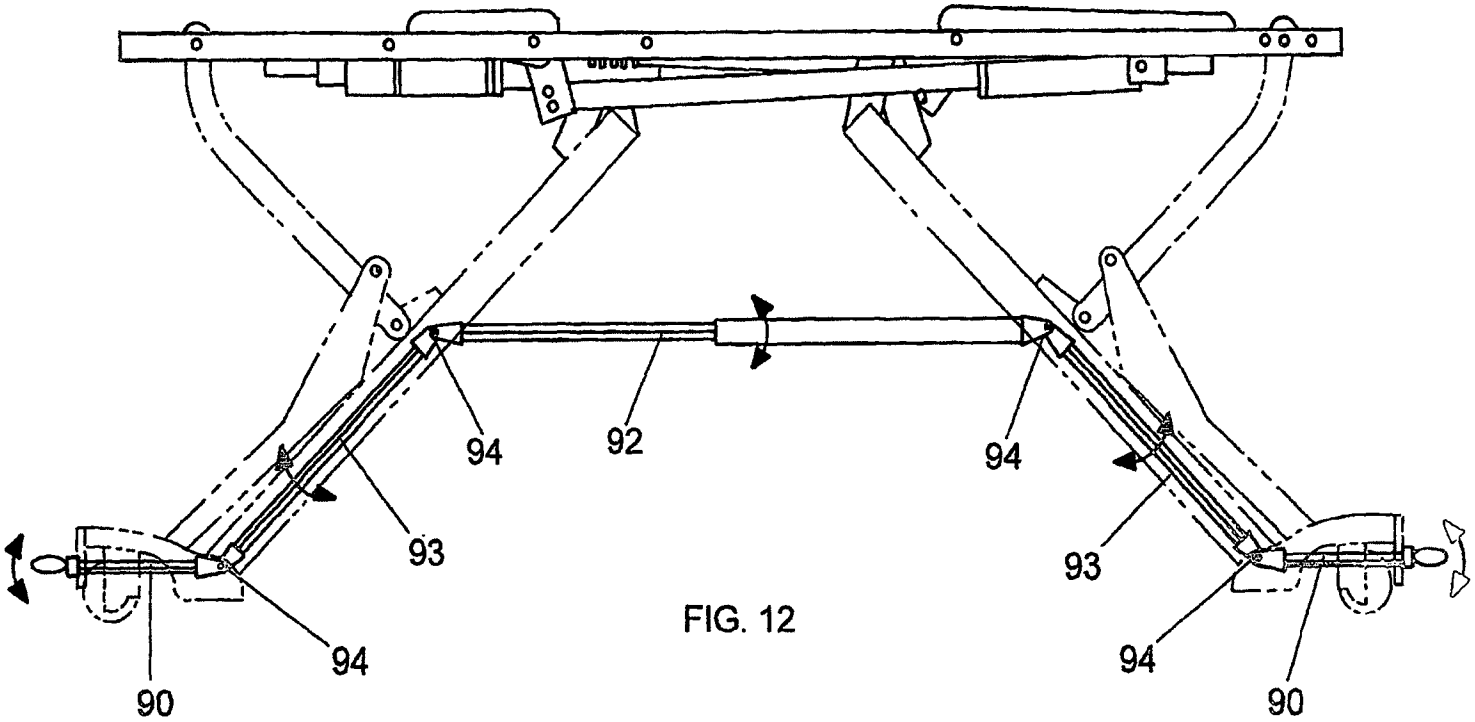

Referring to FIG. 12, yet another embodiment of a means for transmitting a change of locking position is shown. A mechanical linkage is provided that is attached at each end to a foot pedal shaft 90. Linkage shaft 92 extends between the front and rear legs. A linkage shaft extension 93 connects the linkage shaft 92 with each foot pedal shaft 90. The foot pedal shaft, linkage shaft extension, and linkage shaft are attached to one another using universal joints 94. This permits angular movement between the shafts and the shaft extensions during adjustment of the height of the bed. As the height of the bed is adjusted, the legs pivot and the linkage shaft 92 telescopes in length to accommodate the variable distance between the legs. The linkage shaft 92 is elevated with respect to the floor surface (not shown) to permit items to be inserted beneath the bed between the legs. Rotation of a foot pedal 94 produces a direct rotation of the foot pedal shaft 90, linkage shaft extension 93, and linkage shaft 92. This causes a corresponding change in the locking position of the caster assemblies at the opposite end of the bed from the end where the foot pedal is being actuated.

Any of the foregoing embodiments of means for maintaining verticality of the caster stem may be used in conjunction with any of the embodiment of means for transmitting a change in locking position to produce a steerable ultra-low patient bed according to the present invention.

The embodiments are described herein illustratively and are not meant to limit the scope of the invention as claimed. Variations of the foregoing embodiments will be evident to a person of ordinary skill and are intended by the inventor to be encompassed by the following claims.

What is claimed is:

1. An ultra-low patient bed comprising:

a frame supported by front and rear legs, the front and rear legs having an upper end and a lower end, the front and rear legs both movable independently and simultaneously to raise and lower the frame, wherein a leg brace is pivotally connected to the frame and pivotally connected to at least one of the legs;

a first linear actuator configured to provide for movement of the front legs, and a second linear actuator configured to provide for movement of the rear legs, wherein the first and second linear actuators act on the corresponding legs in a direction substantially parallel to the frame;

a caster support member having a longitudinally extending portion directly pivotally connected to the lower end of each leg;

a caster assembly connected to each of said caster support members, each caster assembly having a caster and having a substantially vertical orientation that allows each of said casters to swivel in response to directional changes of the bed, wherein each of the caster assemblies associated with the front legs is independent from the caster assemblies associated with the rear legs; and a constraint structure configured to maintain the substantially vertical orientation of each of the caster assemblies at all height positions of the bed, wherein the front legs and the rear legs are mechanically driven independent of one another and simultaneously when the frame is raised horizontally.

2. The bed according to claim 1, wherein at least one of said longitudinally extending portions extends horizontally past its corresponding caster.

3. The bed according to claim 1, wherein the front legs and the rear legs are configurable to angle the frame relative to horizontal.

4. The bed according to claim 1, wherein the upper end of the front legs and the upper end of the rear legs are translatable along the frame.

5. The bed of claim 1, wherein each caster assembly is a single caster assembly connected to each of said caster support members.

6. The bed of claim 1, wherein the front legs comprise a pair of front legs connected to one another at the upper end thereof and wherein the rear legs comprise a pair of rear legs connected to one another at the upper end thereof.

7. The bed of claim 1, wherein each of the caster support members has an outward end, and each of the caster assemblies is connected at the outward end of the corresponding caster support member.

8. The bed of claim 1, wherein each of the caster assemblies is outward of the frame.

9. The bed of claim 1, wherein each of the constraint structures comprises a control arm pivotally connected to the corresponding caster support member.

10. The bed of claim 9, wherein each of the control arms has a fixed length.

11. The bed of claim 9, wherein one of the control arms is pivotally connected to the leg brace.

12. The bed of claim 9, wherein each of the control arms has a variable length.

13. The bed of claim 12, wherein each of the control arms is connected to a fixed member of the frame.

14. The bed of claim 1, wherein the leg brace comprises:

a front leg brace pivotally connected to the frame and pivotally connected to the corresponding front leg; and a rear leg brace pivotally connected to the frame and pivotally connected to the corresponding rear leg.

15. The bed of claim 1, wherein the frame, the at least one of the legs, and the leg brace are connected to one another at three points which define an isosceles triangle, the isosceles triangle having an apex where the leg brace is pivotally connected to the at least one of the legs.

16. The bed of claim 11, wherein the one control arm, the leg brace, the at least one of the legs, and the corresponding caster support member are connected at four points which define a quadrilateral.

17. The bed of claim 16, wherein the quadrilateral comprising the front legs is substantially a mirror image of the quadrilateral comprising the rear legs when the frame is horizontal.

18. The bed of claim 1, wherein each of the caster support members rotates about a substantially horizontal axis when the height of the frame is adjusted.

19. The bed of claim 1, wherein each of the constraint structures comprises a planetary gear arrangement.

20. The bed of claim 19, wherein each of the planetary gear arrangements is connected to the corresponding caster support member and has a gear ratio selected to maintain the substantially vertical orientation of the corresponding caster assembly as the height of the bed is adjusted.

21. The bed of claim 1, wherein none of the caster assemblies translate along the floor during adjustment of the height of the bed.

22. The bed of claim 21, wherein each of the constraint structures is configured to prevent horizontal translation of the frame during height adjustment of the frame.

23. The bed of claim 1, wherein the point of pivotal attachment of each of the caster support members to the corresponding leg is separated a distance from the floor and wherein the distances remain constant during adjustment of the height of the bed.

24. The bed of claim 1, wherein the lower end of at least one of the legs is spaced apart from the floor.

25. The bed of claim 1, wherein the bed includes a locking structure configured to selectively lock at least one caster assembly and wherein the bed comprises a central actuation mechanism configured to actuate the locking structure.

26. An ultra-low patient bed comprising:

a frame supported by front and rear legs, the front and rear legs having an upper end and a lower end, the front and rear legs movable independently and simultaneously to raise and lower the frame;

a first linear actuator configured to provide for movement of the front legs, and a second linear actuator configured to provide for movement of the rear legs, wherein the first and second linear actuators act on the corresponding legs in a direction substantially parallel to the frame;

a caster support member having a longitudinally extending portion pivotally connected to the lower end of each leg;

a caster assembly connected to each of the caster support members, each of the caster assemblies having a caster and a substantially vertical orientation that allows the caster to swivel in response to directional changes of the bed, wherein the caster assemblies associated with the front legs are independent from the caster assemblies associated with the rear legs; and, a constraint structure configured to (i) maintain the substantially vertical orientation of each of the caster assemblies at all height positions of the bed and (ii) prevent horizontal translation of the bed frame during height adjustment of the bed, wherein the front legs and the rear legs are mechanically driven independent of one another and simultaneously when the frame is raised horizontally, and wherein none of the caster assemblies translate along the floor during adjustment of the height of the bed.

27. The bed of claim 26, wherein the front legs and the rear legs are configurable to angle the frame relative to horizontal.

28. The bed of claim 26, wherein the front legs and the rear legs are mechanically independent of one another.

29. The bed of claim 26, wherein the upper end of the front legs and the upper end of the rear legs are translatable along the frame.

30. The bed of claim 26, wherein each of said caster assemblies is a single caster assembly connected to each of said caster support members.

31. The bed of claim 26, wherein the front legs comprise a pair of front legs connected to one another at the upper end thereof and wherein the rear legs comprise a pair of rear legs connected to one another at the upper end thereof.

32. The bed of claim 26, wherein each of the caster support members has an outward end and the corresponding caster assembly is connected at the outward end to the corresponding caster support member.

33. The bed of claim 26, wherein each of the caster assemblies is outward of the frame.

34. The bed of claim 26, wherein each of the constraint structures comprises a control arm pivotally connected to the corresponding caster support member.

35. The bed of claim 34, wherein each of the control arms has a fixed length.

36. The bed of claim 34, further comprising a leg brace pivotally connected to the frame and pivotally connected to at least one of the legs.

37. The bed of claim 36, wherein the leg brace comprises:

a front leg brace pivotally connected to the frame and pivotally connected to the front leg; and a rear leg brace is pivotally connected to the frame and pivotally connected to the rear leg.

38. The bed of claim 36, wherein the frame, the at least one of the legs, and the leg brace are connected to one another at three points which define an isosceles triangle, the isosceles triangle having an apex where the leg brace is pivotally connected to the at least one of the legs.

39. The bed of claim 36, wherein at least one of the control arms is pivotally connected to the leg brace.

40. The bed of claim 36, wherein at least one of the control arms, the leg brace, the at least one of the legs, and the corresponding caster support member are connected at four points which define a quadrilateral.

41. The bed of claim 40, wherein the quadrilateral comprising the front legs is substantially a mirror image of the quadrilateral comprising the rear legs when the frame is horizontal.

42. The bed of claim 34, wherein each of the control arms has a variable length.

43. The bed of claim 42, wherein each of the control arms is connected to a fixed member of the frame.

44. The bed of claim 26, wherein each of the constraint structures comprises a planetary gear arrangement.

45. The bed of claim 44, wherein each of the planetary gear arrangements is connected to the corresponding caster support member and has a gear ratio selected to maintain the substantially vertical orientation of the corresponding caster assembly as the height of the bed is adjusted.

46. The bed of claim 26, wherein the point of pivotal attachment of each of the caster support members to the corresponding leg is separated a distance from the floor and wherein the distance remains constant during adjustment of the height of the bed.

47. The bed of claim 26, wherein the lower end of each of the legs is spaced apart from the floor.

48. The bed of claim 26, wherein the bed includes a locking structure configured to selectively lock at least one caster assembly and wherein the bed comprises a central actuation mechanism configured to actuate the locking structure.

49. The bed of claim 26, wherein each of the caster support members rotates about a substantially horizontal axis when the height of the frame is adjusted.

* * * * *